United States Patent [19]

Kunst et al.

[11] 4,431,401

[45] Feb. 14, 1984

[54] CONTROL MECHANISM FOR VAPORIZING APPARATUS

[75] Inventors: Theodore F. Kunst, Homewood; Michael N. Koelling, Orland Park, both of Ill.

[73] Assignee: Vapofier Corporation, East Hazelcrest, Ill.

[21] Appl. No.: 278,582

[22] Filed: Jun. 29, 1981

[51] Int. Cl.[3] ..... F23D 11/44

[52] U.S. Cl. ..... 431/11; 431/36; 431/41; 431/207; 431/215

[58] Field of Search ..... 431/36, 41, 207, 215, 431/353, 354, 355, 187, 188, 351, 11; 48/102 A, 107, 144; 126/91 A

[56] References Cited

U.S. PATENT DOCUMENTS 2,231,244 2/1941 Berthiaume et al. ..... 431/351
2,796,118 6/1957 Parker et al. ..... 126/91 A

FOREIGN PATENT DOCUMENTS 2820297 11/1979 Fed. Rep. of Germany ..... 431/351

*Primary Examiner*—Samuel Scott
*Assistant Examiner*—Noah Kamen
*Attorney, Agent, or Firm*—Harry V. Strampel; Ralph R. Rath

[57] ABSTRACT

A vaporizing apparatus includes a vaporizing chamber for producing vapors from a hydrocarbon fuel which are drawn into a mixing chamber by pressurized air, and the mixture is delivered to a manifold where a portion is return to the vaporizing chamber and ignited for heating and vaporization, a safety control system sensing the presence of a flame and the temperature of the vaporization chamber and interrupts flow of vapors when the flame is absent or the temperature is outside prescribed limits. A starter burner which uses the hydrocarbon fuel as a combustible material for preheating the vaporizing chamber is also automatically shut off by the control system when the vaporization chamber reaches the operating temperature. The starter burner includes a mixing valve and a combustion chamber with mixing chamber therebetween for drawing ambient air into the mixture of pressurized air and combustible material.

19 Claims, 4 Drawing Figures

CONTROL MECHANISM FOR VAPORIZING APPARATUS

DESCRIPTION

1. Technical Field

The present invention relates generally to vaporizing apparatus for vaporizing liquid hydrocarbon fuel and, more particularly, to a method for automatically controlling the operation of the apparatus. The present invention also incorporates an improved starter burner for such apparatus.

2. Background Prior Art

Vaporizing apparatus for vaporizing a liquid hydrocarbon fuel have been in existence for a number of years. One type of such apparatus is disclosed in U.S. Pat. No. 2,637,637 and the patents cited therein. Such apparatus has found a remarkable degree of commercial success.

The apparatus disclosed in the above patent, incorporated herein by reference, includes a combustion chamber having a pool of hydrocarbon fuel or oil therein which is initially heated by a starter burner to an operating level at which time vapors are produced. Air is supplied to a mixing chamber which draws the vapors into the mixing chamber where the air and vapors are mixed to a desired combustible ratio. The combustible mixture is then delivered through a manifold to an oven burner. Some of the combustible mixture is also fed via a return line to the vaporizing chamber and is ignited at a pilot burner to maintain the temperature of the vaporizing chamber at the operating level.

When commercial natural gas is available, the commercial gas is connected into the system and is utilized for supplying combustible material to the starter burner until such time as the vaporizing chamber produces vapors from the hydrocarbon fuels. At that time, the commercial gas is shut off by manually closing a valve and then manually opening the oil supply valve and the system operates automatically.

Presently, the largest market for the vaporizing apparatus is in developing countries where commercial gas lines are not available. When commercial gas lines are not available, the initial heating of the combustion chamber is accomplished by a torch at the opening into the vaporizing chamber until enough heat is developed to vaporize the fuel or oil, at which time the oil valve is manually opened and the system becomes operational.

While such a system has been very well received in the industry, numerous shortcomings do exist which require constant operator's time to insure efficient operation. One of the problems inherent in such a system is the manner of shutting down the system after it has been operational for some time. Heretofore this has been done by shutting down the blower which thereby eliminates the pressurized air needed to operate the system to draw vapors from the vaporizing chamber into the mixing chamber. However, most conventional blowers that are used have fans which continue to rotate because of the large mass included in the fan, so that the pressurized air is slowly reduced until the fan ultimately stops turning. Thus, even after the fan has been shut down, some of the vapor products continue to be drawn into the mixing chamber and flow out the manifold to the oven burner where they remain ignited. Usually, at some point in time, the pressurized air is not sufficient to maintain the flame outside the oven burner and the vapors within the system begin to burn back through the manifold and the mixing chamber all the way back to the vaporizing chamber where a sudden explosion occurs. Such sudden explosion is not only scary for the operator but may also create substantial safety hazards.

A further problem inherent in the systems presently being marketed is the fact that the operator must constantly maintain surveilance of the equipment to insure that the burning mixture of vapors and air returning to the vaporization chamber is not extinguished. Additional safety hazards that may result in damage to the equipment or injury to the operator is the possibility of overheating the system. Presently, the only monitoring mechanism incorporated into the commercial units is a temperature sensing device which senses the temperature of the vaporization chamber by sensing the temperature of the lower wall thereof and activating a light adjacent the unit to give an indication to the operator that the unit is at its operating temperature, whereupon the operator manually opens certain valves and closes other valves to discontinue the use of the starter burner and continue heating of the vaporization chamber utilizing vapors produced by the system.

Another shortcoming of the prior art devices is the fact that either a liquid propane in a pressurized container or a commercially available gas line must be present to initially heat the vaporizing chamber. While it has been proposed to utilize the hydrocarbon fuels that are being vaporized to preheat the chamber, to date, no starter burner has been used successfully for initially heating the vaporization chamber with the hydrocarbon fuel without the use of some other combustible material.

SUMMARY OF THE INVENTION

According to the present invention, a control system has been developed which automatically initiates preheating of the vaporization chamber and then automatically converting the unit to use the vapors produced for maintaining the temperature of the vaporizing chamber at a selected operating level. The control system also incorporates mechanism which will automatically interrupt flow of vapors whenever the open flame is extinguished or the temperature of the vaporizing chamber is above or below a selected value.

More specifically, the control system of the present invention is adapted to be easily incorporated into a vaporizing apparatus that includes a vaporizing chamber having a conduit leading therefrom to deliver vapor into a mixing chamber which also has pressurized air supplied thereto and returning some of the mixture through a return line that terminates adjacent an opening in the mixing chamber so that the return mixture is ignited to produce an open flame. Electrically-operated control valves are incorporated into the conduits and the control system includes flame sensing means for sensing the presence or absence of the flame adjacent the chamber opening. Electronic controls are incorporated into the control system to automatically close the valve in the event the flame becomes extinguished. The control system also incorporates a temperature sensing mechanism for sensing the temperature of the vaporizing chamber and automatically activates the electronic controls to close the valves when the temperature exceeds a preselected level and falls below a preselected level.

The control system also incorporates electronics to automatically shut down the starter burner when the vaporizing chamber is at a normal operating temperature. More specifically, solenoid-operated control valves in air and combustible mixture conduits leading to the burner are opened by electronic means when the system is to be activated so that a combustible material is present at the starter pilot and may be ignited to heat the vaporizing chamber to the operating level. When the vaporizing chamber reaches the operating temperature, the electronic control automatically discontinues the flow of combustible materials by closing the valve and opening the other two valves so that the heating of the vaporizing chamber is accomplished with the vapors produced in the vaporizing chamber.

According to a further aspect to the invention, the vaporizing apparatus of the present invention also incorporates a unique starter burner which is capable of preheating the vaporizing chamber utilizing the same hydrocarbon fuels that are ultimately vaporized by the apparatus. The starter burner includes a mixing valve which receives air under pressure that draws a predetermined amount of oil from a gravity-fed supply which is mixed therewith and produces an output spray. The output spray is delivered to an open-ended combustion chamber with a mixing chamber located between the combustion chamber and the mixing valve for drawing ambient air into the spray. The combustion chamber has ignition means for igniting the spray and maintaining ignition. Under certain conditions, it may also be desirable to have a further heating means in the combustion chamber to preheat the chamber so that ignition may be maintained.

BRIEF DESCRIPTION OF SEVERAL VIEWS OF DRAWINGS

DETAILED DESCRIPTION

Figure 1:
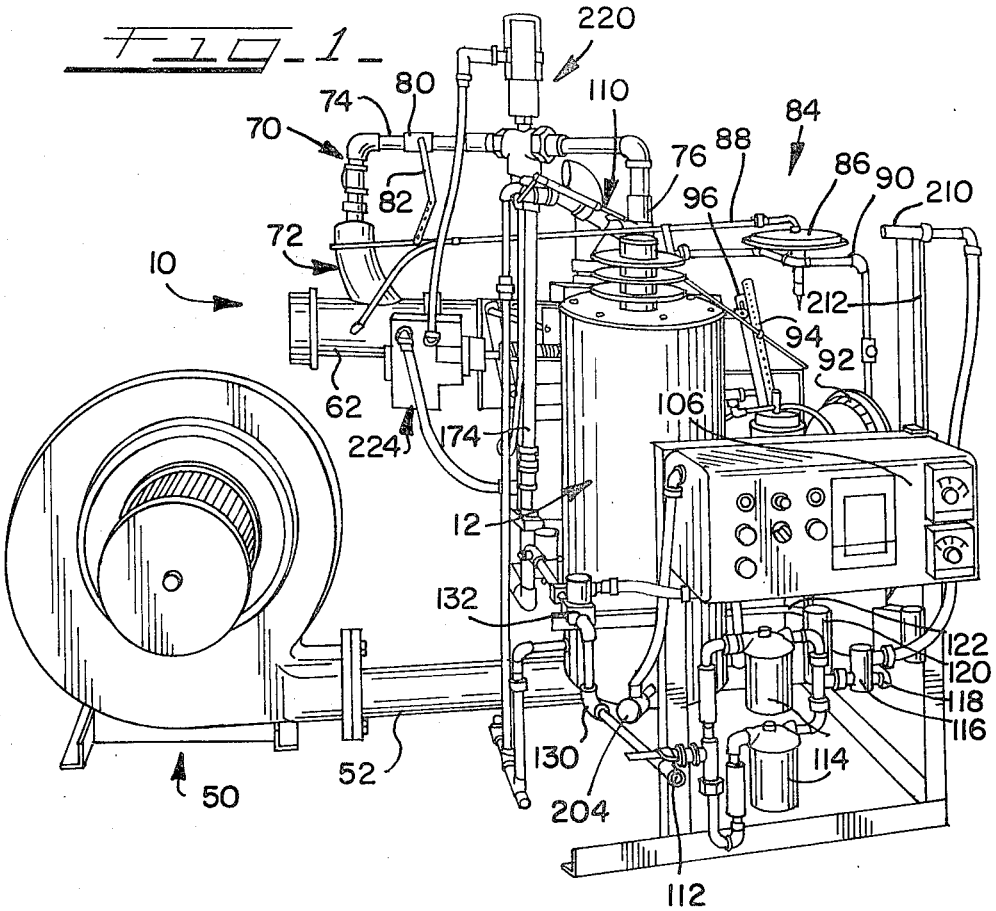
FIG. 1 is a perspective view of a vaporizing apparatus having features of the present invention incorporated therein.

While this invention is susceptible of embodiment in many different forms, there is shown in the drawings and will herein by described in detail a preferred embodiment of the invention with the understanding that the present disclosure is to be considered as an exemplification of the principles of the invention and is not intended to limit the invention to the embodiment illustrated.

Figures 3, 4:
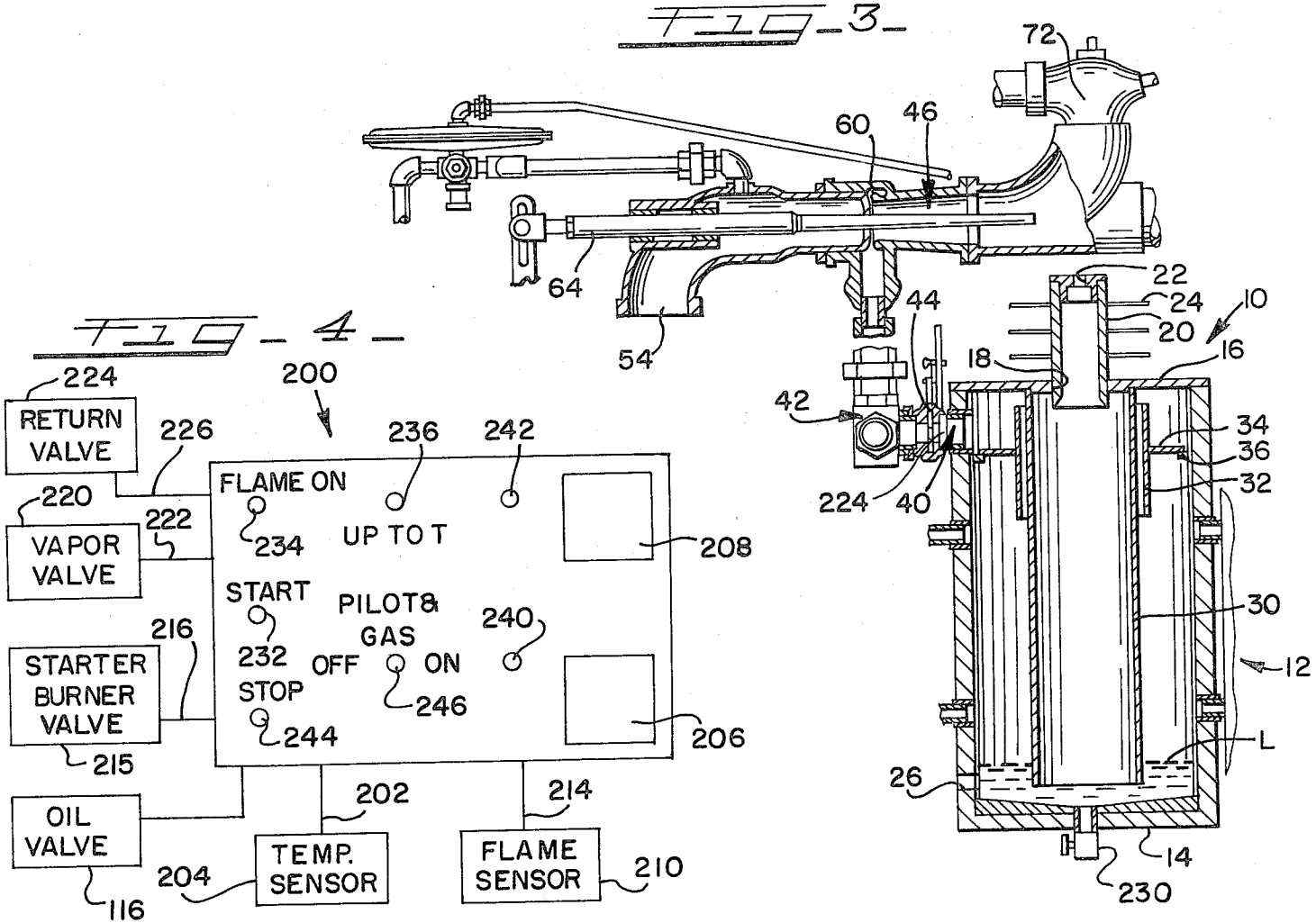
FIG. 3 is a view partly in cross-section showing the various components generally in schematic form; and, FIG. 4 is a block diagram of the safety control system.

FIGS. 1 and 3 of the drawings disclose a vaporizing apparatus, generally designed by reference numeral 10. Vaporizing apparatus 10 includes a vaporizing chamber 12, which is generally cylindrical in cross-section, has a bottom wall 14 and a top wall 16. Top wall 16 has a centrally located opening 18 with an extension 20 extending above the top wall 16 and a reduced opening 22 at the upper end of extension 20 with heat transfer fins 24 extending around the perimeter thereof. The hydrocarbon fuel or oil is delivered to the vaporizing chamber through a lower inlet 26, as will be described later.

Vaporizing chamber 12 has a combustion tube 30 which is axially aligned with opening 18 and is sealed to the top wall 16 while the lower end thereof is spaced from the bottom wall 14 and terminates below the liquid level of the fuel, indicated by reference L. An annular sleeve 32 is spaced from and extends around tube 30 and is also spaced from top wall 16. Sleeve 32 is supported in the position illustrated by an annular or baffle plate 34 which is secured as by welding to the periphery of sleeve 32 and is supported and secured on an inwardly-directed flange 36 extending from the inner surface of vaporizing chamber 12. Vaporizing chamber 12 has an outlet 40 located about baffle plate 34 so that hot, combustible materials from a burner, to be described later, can enter inlet opening 22 and flow downwardly within combustion tube 30 through the fuel or oil and flow through the annular space between combustion tube 30 and sleeve 32 to thereby supply additional heat to the vaporized product.

The vaporized product flowing through outlet 40 is received by a conduit means 42 having a regulator valve 44 therein and is delivered to a mixing chamber, generally designated by reference numeral 46. A blower 50 has its outlet conduit 52 connected to inlet 54 of the mixing chamber. An annular Venturi opening 60 connects conduit means 42 to mixing chamber 46. Thus, the oil vapor is drawn into the mixing tube through opening 60 by the air flow from blower 50. A mixture is formed within mixing chamber 46 and is delivered to manifold 62 for delivery to a burner (not shown). The amount of air received by mixing chamber 46 is controlled by a movable valve element 64, as will be described later.

As indicated above, some of the mixture of air and vapors is utilized for maintaining the vaporizing chamber 12 at its operating temperature. For this purpose, manifold 62 has a return conduit means 70 (FIG. 1) including an angular member 72 extending from manifold 62 and a conduit 74 leading to a pilot burner 76 which is spaced above the upper end of extension 20 and is axially aligned therewith. A flow control valve 80 is also located in conduit 74 and is controlled by movement of a control arm 82.

The opening and closing of valves 44, 64 and 80 is controlled automatically by a regulating mechanism generally designated by reference numeral 84. Air pressure within manifold 62 is fed to a diaphram in a housing 86 through a conduit 88. The opposite side of the diaphram in housing 86 communicates through conduit 90 with a further diaphram in a diaphram housing 92. Increases and decreases in pressure within manifold 62 will be sensed by the diaphram within housing 86 which is then transmitted to the diaphram in housing 92 to move a cross-shaft (not shown) and move control arms 94 and 96 to move valve elements 44, 64 and 80 towards the opened and closed positions to automatically regulate the entire system, as explained in the above-mentioned patent and patents cited therein.

With the apparatus so far described, vapors are developed from the fuel or oil in the combustion chamber and flow through outlet 40. The vapors are drawn into the mixing chamber through Venturi 60 by the air flow developed by the blower 50 and are mixed with the air and delivered to manifold 62 for supply to a burner. Some of the mixture of air and vapors is returned through return conduit means 70 and is ignited at the outlet end of burner 76 so that the ignited gases flow through tube 30 and through the liquid fuel to vaporize the fuel and to maintain the combustion chamber at the operating temperature.

As indicated above, some type of external heating means is necessary to bring the combustion chamber to the operating temperature and this is normally accomplished by utilizing natural gas, if available, which can also be utilized for operating the burners while the combustion chamber is being heated to the operating temperature. However, in many instances, commercial natural gas is not available and it is then necessary to acquire liquid propane tanks that can be utilized to supply combustion materials to a torch to bring the combustion chamber to an operating temperature. In either case, the technique for heating the combustion chamber to an operating temperature is extremely expensive and requires substantial operator attention.

According to one aspect of the present invention, the vaporizing apparatus incorporates a starter burner that can be operated with the hydrocarbon fuel or oil that is being vaporized and, thus, requires no external gas source which was heretofore necessary for heating the vaporizing chamber to the operating temperature. The pilot burner 110 of the present invention is positioned adjacent burner 76 and is adapted to supply ignited combustible materials to the inlet opening 22 of extension 20.

The fuel for the vaporizing chamber, as well as the starter burner 110, is supplied from the elevated tank (not shown) and is gravity-fed into an inlet 112. The fuel flows from inlet 112 to a pair of filters 114 to an electrically-operated fuel control valve 116. The outlet of fuel or oil control valve 116 is connected via a conduit 118 to a float valve mechanism 120 which has its lower end connected to fuel inlet 26 and its upper end connected via a conduit 122 to the vaporization chamber above the liquid level in the tank. Thus, equal pressure conditions are maintained in both the float chamber and the vaporizing chamber so that the fuel is gravity-fed into the vaporizing chamber. It has been found that having the oil flow into the chamber rather than being drawn in provides more accurate control of the oil level in combustion chamber 12.

The hydrocarbon fuel is also gravity-fed from inlet 112 to starter burner 110 through a conduit 130 having an electrically-actuated starter control valve 132. Pressurized air from blower 50 is also connected to a mixing valve 136 via a conduit 134. Mixing valve 136 is a commercially available spray paint mixing valve manufactured by Spraying Systems Co., Inc. Mixing valve 136 receives a constant supply of air under pressure from conduit 134 and a variable supply of oil from conduit 130 controlled through a needle valve having an actuator 138. The air supply flows through a center opening 140 and produces a spray output 142 having a generally conical pattern into which fuel is drawn from passages 144 in mixing valve 136. The spray output is directed towards a combustion chamber 150 with a mixing chamber 152 located between combustion chamber 150 and mixing valve 136. The mixing chamber 152 is a generally conical member having a plurality of circumferentially-spaced openings 154 so that ambient air can be drawn into the spray output.

The combustion chamber 150 includes a generally cylindrical member 156 that is open at both ends and has ignition means in the form of a spark plug 158 extending through the cylindrical wall, as well as a glow plug or heating means 159. An annular sleeve 160 of reduced diameter is positioned adjacent the inlet end of combustion chamber 150 and is held in fixed position by circumferentially-spaced spot welds 162 to define an annular opening 164.

Thus, the pressurized air from blower 50 is initially mixed with the oil or combustible material and is emitted in a conical spray pattern through mixing chamber 110 where ambient air is drawn in through openings 154 into annular opening 164 and into the conical spray pattern in combustion chamber 150.

In the embodiment illustrated, conduits 130 and 134 are housed in a rigid pipe 174 (FIG. 1) which also supports the oil starter burner 110.

Figure 2:
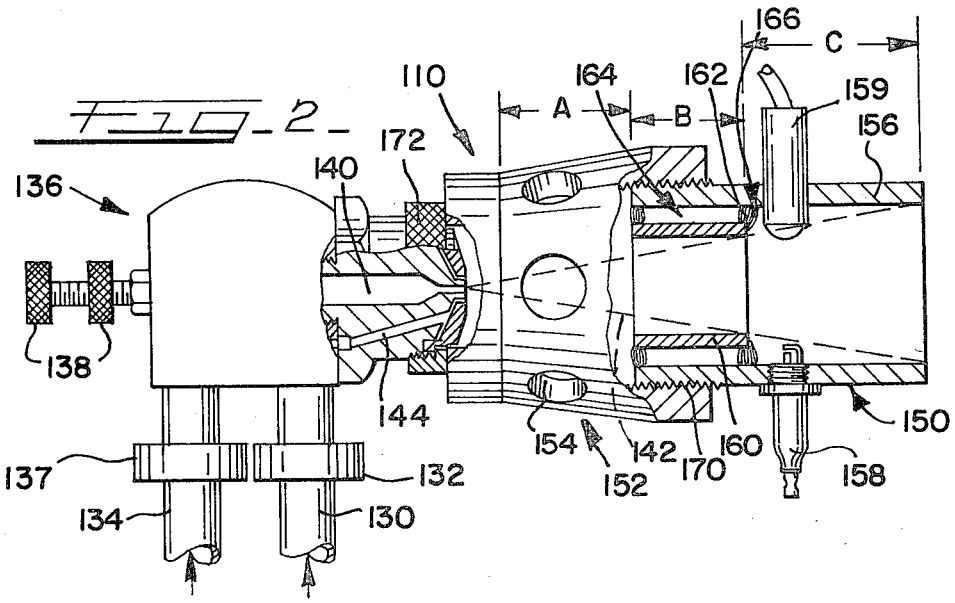
FIG. 2 is a side elevational view, partly in section, of the pilot burner.

It has been determined that the axial dimensions of the mixing chamber and combustion chamber, as well as the overall area of the openings in mixing chamber 152, are critical to produce an effective combustion burner. As illustrated in FIG. 2, the conical spray pattern 142 defines a cross-sectional area at the outlet end of sleeve 160 which is substantially equal to the cross-sectional area of the end of sleeve 160 while the cross-sectional area of the conical pattern also is substantially equal to the outlet area of the combustion chamber. Thus, an annular void 166 is created adjacent the inner end of annular sleeve 160 thereby creating a vacuum which will draw the ambient air through annular opening 164 to mix with the premixed air and oil. In a specific construction that has been proven successful, the axial dimension A of mixing chamber 110 is approximately 1 inch, while the axial dimension B of the reduced diameter sleeve 160 is approximately $\frac{3}{4}$-inch and the axial dimension of C between the inner end of sleeve 160 and the open end of combustion chamber 150 is $1\frac{3}{4}$ inches. Stated another way, the axial dimension of the combustion chamber is greater than the axial dimension of the mixing chamber, which in turn is greater than the axial length of annular opening 164. The relative dimensions will insure that the diameter of the spray pattern at the outlet to sleeve 160 is substantially equal to the diameter of the sleeve and that the diameter of the spray pattern is substantially equal to the diameter of combustion chamber 150 at the outlet opening.

It has also been determined that the total area of openings in relation to the cross-sectional area of the combustion chamber is critical to provide a proper flow of ambient air into the chamber 152 for flowing through annular opening 164. In actual practice, it has been determined that a total of six equally circumferentially spaced openings having a diameter of 9/16-inch will provide a sufficient open area for allowing adequate ambient air to enter into chamber 150 which has a diameter of about 1 inch. Thus, the total area of the spaced openings is substantially greater than the cross-sectional area of the combustion chamber, and with the above dimensions is more than three times greater than the cross-sectional area. While the assembly of the components is not critical, the preferred embodiment shows the members 152 and 156 being secured to each other by cooperating threads 170 while member 152 is secured to mixing valve 136 by a nut 172 attached to the end of member 152.

According to the primary aspect of the present invention, the vaporizing apparatus described above incorporates an automatic control system which will shut down or discontinue operation upon the occurance of any number of events which could damage the equipment or may result in injury to the operator. The control system is also designed to automatically interrupt the flow of combustible materials to the pilot burner when the vaporization chamber reaches its operating temperature. The control system is schematically illustrated in FIG. 4 and includes a main control panel 200 which houses all of the electronic equipment and has a number of control buttons and lights which will be described later.

The electric control system includes a temperature sensing means or thermocouple 204 which is secured to bottom wall 14 of vaporizing chamber 12 and connected to control panel 200 by a line 202. The control panel 200 has a lower temperature limit gauge 206 and an upper limit temperature gauge 208, both of which can be manually set to thereby set the operating temperature for vaporization chamber 12 and also set the maximum temperature at which the unit can be operated safely.

The electric control system also incorporates a flame sensing means 210 (FIG. 1) which is supported on a post 212. The flame sensor 210 is positioned to be directed towards the space between burner 76 and the upper edge of extension 20. Flame sensor 210 is electrically connected to control panel 200 through lead 214 while starter burner valve means 215, which includes valves 132 and 137, is connected by lead 216 to the control panel 200. The electric control system also includes an electrically- or solenoid-operated vapor valve 220 connected by lead 222 to control panel 200 and a return conduit valve 224 connected to control panel 200 by lead 226. The solenoid-operated oil control valve 116 is also connected via a lead 230 to control panel 200.

The operation of the automatic electric control system will be described in connection with initial start up with the vaporizing chamber at room temperature.

Initially, all of the oil in the vaporizing chamber is drained by opening a drain valve 230 (FIG. 3). To initiate operation, a start button 232 on control panel 200 is depressed which will immediately supply power to spark plug 158 and glow plug 159. If the oil starter burner is being utilized, the starter burner chamber 150 is preferably initially preheated for a short period of time by the glow plug before oil is actually introduced into the burner. This may be accomplished by a time delay (not shown) incorporated into the electronic control panel 200.

After the preset time delay, the control system 200 starts blower 50 and opens starter burner valve means 215, including oil valve 132 and air valve 137. Air at a constant pressure and flow rate flows through tube 134 and draws the oil from passages 144 into the conical spray pattern 142 and ambient air is mixed with the spray and is ignited by spark plug 158. Needle valve 138 is utilized to adjust the proper amount of oil in the mixture. Thus, the ignited combustible materials are utilized to bring the vaporizing chamber 12 to an operating temperature, which can be manually set by adjustment of the lower limit temperature sensor and gauge 206. When ignition has been obtained, an indicator light 234 is energized to give the operator an indication that the combustible materials have ignited.

When the combustion chamber reaches the operating temperature, the lower limit set by gauge 206, an indicator light 236 is energized to indicate to the operator that the vaporizing chamber is at the operating temperature. At this time, the control system energizes the solenoids of vapor valve 220 and return valve 224, as well as the oil valve 116. Preferably, a short time delay is incorporated into the time between which the vaporizing chamber reaches the operating temperature and the respective valves are opened. This time delay is utilized to slightly overheat the vaporizing chamber above the operating temperature to compensate for the temperature of the oil when it enters the chamber which is at ambient conditions. At this time, the oil or hydrocarbon fuel is vaporized by the continued flow of ignited combustible materials into the combustion tube 30 and the vapors flow through the annular opening around the tube to the outlet 40 into conduit means 42. Pressurized air received into inlet 54 from blower 50 draws these vapors into the mixing chamber 46 through the annular Venturi opening 60 and the mixture is delivered to the manifold 62 where some of it is returned through conduit means 70 and ignited at the pilot burner 76. If desired, the solenoid or oil valve 116 may be energized by depressing the control button 240 on control panel 200 at the time the temperature light 236 turns on to allow the oil to be gravity-fed into the lower end of vaporizing chamber 12 to be heated to the operating temperature of the vaporizing chamber before the valves 220 and 224 are opened. When the mixture of vapors and air begin flowing through return conduit 70, it is ignited at burner 76 by flames from starter burner 110, at which time the control system 200 automatically closes valves 132 and 137 to close down the starter burner 110. Thereafter, the vapors that are produced in vaporizing chamber 12 are utilized for maintaining the vaporizing chamber at its operating temperature. Once the system becomes self-contained, the automatic control and safety system 200 insures that the vaporizing apparatus remains operating within prescribed temperature limits set by the lower temperature sensor or gauge 206 and the upper limit sensor or gauge 208. During this time, the flame sensor 210 continually monitors the presence or absence of a flame at the outlet of pilot burner 76.

If, for any reason, the pilot burner flame is extinguished, sensor 210 will send a signal through line 214 to the electronic controls in control panel 200 and will automatically de-energize vapor valve 220 and return valve 224, as well as shut down the blower to prevent any prolonged flow of combustible materials, particularly in return line 70. The operator may then be alerted by a suitable signaling device, such as a horn, to indicate that the system has been shut down.

The control system 200 also automatically maintains the vaporizing chamber within operating parameters set by the gauges 206 and 208. If the temperature of the vaporizing chamber 12, particularly the lower wall 14, at any time exceeds the gauge setting or falls below the gauge setting, the electronics in the control panel 200 automatically shuts down the system, as described above. Of course, if the operates wishes to shut down the system, he can depress a stop button 244 on control panel 200 which will close vapor and return valves 220 and 224 immediately and also close oil valve 116 either manually or electronically to interrupt the flow of vapors through conduit means 42 and return means 70 which will prevent the undesirable burn back of vapors, as described above.

As can be appreciated from the above description, the safety control system of the present invention assures that the vaporizing chamber is maintained within desired parameters at all times which protects and prolongs the life of the equipment and also reduces the safety hazards that heretofore have been inherent in a control system of this type.

Of course, numerous modifications come to mind without departing from the spirit of the invention. For example, if suitable commercial gas is available, such source can be connected directly to conduit 130 and utilized as the combustible materials for the starter burner 110. This may be desirable in certain areas, since it would allow the oven burners to be operated with the commercial gas while the vaporizing chamber is being heated to its operating temperature. If natural gas or commercial gas is utilized, preferably a further control button 246 is incorporated into the control panel 200 to allow the operator to manually energize the solenoid or solenoids for the starter burner valve means 215 including combustible material valve 132 and air valve 137. In such instance, the starter burner 110 would be replaced with a burner that would be more suitable for mixing commercial gas with the pressurized air.

We claim:

1. In a vaporizing apparatus for vaporizing liquid hydrocarbon fuels comprising a vaporizing chamber having an opening and a pool of fuel therein, a mixing chamber, a vapor conduit leading from said vaporizing chamber to said mixing chamber and having an electrically-operated vapor valve therein, a return conduit having an electrically-operated return valve for returning a mixture of vapor and air to said vaporizing chamber, said return conduit terminating spaced from said opening to produce an open flame adjacent said opening, the improvement of electric control means including flame sensing means for sensing the presence of said flame, temperature sensing means for sensing the temperature in said vaporizing chamber, and electronic means for closing said valves when (1) the temperature exceeds a certain level, or (2) the flame is absent.

2. A vaporizing apparatus as defined in claim 1 further including a pilot burner adjacent said open end with conduit means for supplying air and a combustible material thereto for heating said vaporizing chamber to an operating temperature, said conduit means having an electrically-operated burner control valve means therein, said electronic means initially opening said burner control valve means to supply air and combustible material to said pilot burner to heat said vaporizing chamber to said operating temperature while maintaining said vapor valve and said return valve closed, said temperature sensing means and electronic means (1) opening said vapor valve and said return valve when said vaporizing chamber is above said operating temperature, and (2) closing said burner control valve means.

3. A vaporizing apparatus as defined in claim 2 in which said pilot burner has ignition means and said combustible material is said hydrocarbon fuel.

4. In a vaporizing apparatus for vaporizing liquid hydrocarbon fuels comprising a vaporization chamber having a level of fuel therein with means for supplying fuel thereto, blower means for supply air, a mixing chamber receiving said air and vapors from said vaporization chamber, means for returning a portion of the mixture toward said vaporization chamber where it is ignited to produce an open flame directed through an opening into said vaporization chamber for heating and vaporization, the improvement comprising control means for controlling operation of said vaporization apparatus and including flame sensing means for detecting said open flame, and means for interrupting flow of vapors to said mixing chamber when said sensing means detects the absence of said open flame.

5. Vaporizing apparatus as defined in claim 4, further including temperature sensing means in said control means for sensing the temperature of said vaporization chamber and interrupting flow of said vapors when the temperature exceeds a certain level.

6. Vaporization apparatus as defined in claim 4 in which said control means includes further means for substantially simultaneously interrupting return flow from said mixing chamber to said vaporization chamber.

7. Vaporizing apparatus as defined in claim 5, further including a starter burner having conduit means for supplying a combustible mixture and a valve means in said conduit means, said control means including means for opening only said valve means to supply said combustible material to initially heat said vaporization chamber to an operating temperature, said temperature sensing means sensing when said vaporization chamber reaches said operating temperature and said control means closing said valve means and allowing flow of said vapors to said mixing chamber and return flow to said vaporization chamber.

8. In a vaporizing apparatus for liquid hydrocarbon fuels which includes a vaporizing chamber having a level of liquid therein, means for supplying fuel to said chamber, heating means for heating said chamber to produce vapors from said fuel, a mixing chamber for combining air with said vapors from said vaporizing chamber, means for withdrawing a portion of said mixture from said mixing chamber for return to said vaporizing chamber where it is ignited producing a flame which is directed into said vaporizing chamber for heating and vaporization, the improvement of control means for controlling operation of said apparatus and including temperature sensing means sensing the temperature of said vaporizing chamber, and electronic means for interrupting flow of vapors from said vaporizing chamber when said temperature is outside prescribed limits.

9. A vaporizing apparatus as defined in claim 8 in which said electronic means substantially simultaneously interrupts return flow of said mixture to said vaporization chamber when said temperature is outside said prescribed limits.

10. A vaporizing apparatus as defined in claim 9 in which said flame is an exposed flame above said vaporizing chamber and in which said control means including sensing means for sensing the presence of said exposed flame and interrupting said flow of vapors and said return flow when said exposed flame is absent.

11. In a vaporizing apparatus for vaporizing oil comprising an upwardly open end vaporizing chamber having a pool of oil therein with gravity-feed means maintaining said pool at a predetermined level, a starter burner adjacent said open end and having a mixing valve connected to said gravity-feed means, means for supplying pressurized pneumatic fluid to said mixing valve to produce a spray of pressurized pneumatic fluid and oil, means for introducing ambient air into said spray, and ignition means for igniting said spray for heating said vaporizing chamber.

12. A vaporizing apparatus as defined in claim 11 in which said starter burner includes a generally cylindrical combustion chamber having an inlet and an outlet, means adjacent said inlet defining a peripheral annular flow passage around said spray.

13. A vaporizing apparatus as defined in claim 12 in which said means adjacent said inlet includes a reduced diameter sleeve having one end aligned with said inlet and an opposite end intermediate said inlet and said outlet.

14. A vaporizing apparatus as defined in claim 13 in which said means for introducing ambient air includes an axially extending member between said mixing valve and said inlet, said member having circumferentially spaced openings for receiving said ambient air.

15. A vaporizing apparatus as defined in claim 14 in which said spray has a conical pattern having a constantly increasing diameter between said mixing valve and said outlet and in which the diameter of said conical pattern is substantially equal to an internal diameter of said sleeve at said opposite end of said sleeve and substantially equal to an internal diameter of said cylindrical combustion chamber at said outlet.

16. A vaporizing apparatus as defined in claim 15 in which said starter burner has a mixing chamber between said mixing valve and said combustion chamber and in which the axial dimension of said combustion chamber is greater than the axial dimension of said mixing chamber and the axial dimension of said annular flow passage is less than the axial dimension of said mixing chamber.

17. A vaporizing apparatus as defined in claim 16 in which the total cross-sectional area of said circumferentially spaced openings is substantially greater than the cross-sectional area of said combustion chamber.

18. A method of controlling a vaporizing apparatus having a vaporizing chamber, conduit means leading from said vaporizing chamber to a mixing chamber and a return conduit leading from said mixing chamber to said vaporizing chamber and terminating adjacent an opening in said vaporizing chamber so that (1) vapors flow through said conduit means, and (2) mix with air in said mixing chamber for delivery to a burner while a portion of said mixture is returned and is ignited to produce an exposed flame adjacent said opening, comprising the steps of sensing the presence of said exposed flame, sensing the temperature of said vaporization chamber and substantially simultaneously interrupting flow in said conduit means and said return conduit when (1) said temperature exceeds a certain level, or (2) the exposed flame is absent.

19. A method as defined in claim 18 in which said conduit means and return conduit have control valves therein, and further including a starter burner adjacent said opening and having starter conduits with valves for supplying a combustible material, the further steps of initially opening the starter burner conduit valves to preheat said vaporizing chamber and closing said starter burner conduit valves and substantially simultaneously opening said conduit means and said return conduit when said vaporizing chamber is at an operating temperature.

* * * * *